United States Patent [19]

Randall

[11] Patent Number: 4,712,676

[45] Date of Patent: Dec. 15, 1987

[54] SHIPPING PACKAGE CONTAINING COILED FASTENER PACKAGES

[75] Inventor: Warwick Randall, Warwick, R.I.

[73] Assignee: Stanley-Bostitch, Inc., East Greenwich, R.I.

[21] Appl. No.: 837,320

[22] Filed: Mar. 3, 1986

Related U.S. Application Data

[63] Continuation of Ser. No. 661,475, Oct. 16, 1984, abandoned.

[51] Int. Cl.[4] ..... D65D 85/24

[52] U.S. Cl. ..... 206/338; 206/341; 206/593

[58] Field of Search ..... 206/145, 338, 341, 343, 206/345, 346, 347, 389, 390, 392, 395, 485, 486, 593, 594; 220/23.6; 229/42

[56] References Cited

U.S. PATENT DOCUMENTS

| | | | |
|---|---|---|---|
| 1,613,152 | 1/1927 | Agar | 206/486 |
| 2,129,488 | 9/1938 | Bomberger | 206/145 |
| 2,152,847 | 4/1939 | Helm et al. | 206/338 |
| 2,476,623 | 7/1949 | Peterson | 206/454 |
| 2,597,377 | 5/1952 | Robinson | 206/486 |
| 2,744,624 | 5/1956 | Hoogstoel et al. | 206/594 |
| 2,761,553 | 9/1956 | Wheeler | 206/594 |
| 3,083,369 | 4/1963 | Peterson . | |
| 3,438,487 | 4/1969 | Gallee et al. . | |
| 3,450,255 | 6/1969 | Mosetich . | |
| 3,621,995 | 11/1971 | Francis | 206/392 |
| 3,708,946 | 1/1973 | Cahill | 206/593 |
| 3,718,254 | 2/1973 | Stephenson | 229/42 |
| 3,758,018 | 9/1973 | Black | 229/42 |
| 3,804,234 | 4/1974 | Gorden | 206/392 |
| 3,828,925 | 8/1974 | Magyar et al. | 206/346 |
| 3,927,459 | 12/1975 | Haytayan | 206/346 |
| 4,117,930 | 10/1978 | Pavel | 206/382 |
| 4,314,638 | 2/1982 | Gorden et al. | 206/594 |
| 4,386,697 | 6/1983 | Zocher | 206/383 |
| 4,508,220 | 4/1985 | Pearson | 206/343 |

*Primary Examiner*—George E. Lowrance
*Assistant Examiner*—David T. Fidei
*Attorney, Agent, or Firm*—Cushman, Darby & Cushman

[57] ABSTRACT

A shipping package comprising an exterior carton having a rectangular bottom, sides and top closure defining an interior space. A bottom panel, a top panel, and usually at least one divider panel are mounted within the interior space dividing the same into a plurality of tiered spaces. The construction of the panels is such that each tiered space is defined along its lower surface by an upwardly facing corrugated sheet and along its upper surface by a downwardly facing corrugated sheet. A plurality of coiled fastener packages are mounted within each tiered space so that the fastener head defining end thereof engages one of the corrugated sheets defining the same so as to collapse the engaged corrugations thereof and the fastener point defining end thereof engages the other of the corrugated sheets defining the same so as to penetrate the engaged corrugations thereof.

11 Claims, 6 Drawing Figures

SHIPPING PACKAGE CONTAINING COILED FASTENER PACKAGES

This is a continuation of application Ser. No. 661,475, filed Oct. 16, 1984, which was abandoned upon the filing hereof.

FIELD OF THE INVENTION

This invention relates to coiled fastener packages and, more particularly, to improved shipping packages containing a multiplicity of coiled fastener packages.

BACKGROUND OF THE INVENTION

The present invention is particularly concerned with coiled fastener packages of the type disclosed in U.S. Pat. No. 3,083,369. The coiled fastener package shown therein is formed by wrapping in a coil formation an assembly which includes a multiplicity of fasteners, each having a shank with headed and pointed ends and an elongated carrier supporting the fasteners in parallel relation with respect to one another in transverse relation to the longitudinal extent of the carrier. The carrier disclosed in the patent consists essentially of two parallel weldable wires which are extended across the fastener shanks and welded thereto. The present invention also relates to coiled fastener packages utilizing other carriers as, for example, the plastic strip carrier disclosed in U.S. Pat. No. 3,438,487 and the coiled package formed therefrom as disclosed in U.S. Pat. No. 3,450,255.

An advantage of the parallel wire carrier over the plastic strip carrier is that a significantly greater fastener density can be embodied in a given size coiled package. This greater fastener density is achieved by virtue of an increase in the number of volutes or turns into which the assembly can be wrapped in any given size coil formation. Stated differently, with a parallel wire carrier, the fasteners of adjacent volutes can be brought into abutting engagement to the extent that heads overlap. On the other hand with the plastic strip carrier, the plastic strip serves as a spacer between the fasteners of adjacent volutes to the extent of providing head spacing.

An advantage of the plastic strip carrier over the parallel wire carrier is that the assembly can be wrapped in a flat coil formation wherein the fastener heads are disposed generally in a single plane because they are spaced from one volute to the next. On the other hand, the parallel wire-fastener assembly required overlapping the fastener heads from one volute to the next because of their abutting relationship. The result was that the coiled package had one end which was concavely frustoconical while the other was convexly frustonconical. Coiled fastener packages with this end configuration are referred to as "domed". Usually, the head end was the domed end.

These domed packages presented particular difficulties in shipping. Heretofore, in order to prevent damage in shipping, it has been necessary to provide a molded foam plastic (EPS) tray in supporting relation to a series of domed packages along their bottom ends and a different complementary molded foam plastic tray in engagement with the top domed ends. The top molded tray included concave surfaces for receiving the convex domed headed ends of the fastener packages, while the bottom molded tray included convex surfaces for entering the concave pointed ends of the fastener packages.

In this way each coiled package was firmly supported. The molded trays added significant costs, presented storage difficulties because of the fire hazard presented (toxic fumes) and presented disposal problems because of being incapable of safe burning and a disposable problem because the trays are not biodegradable.

With the recent development of a method of wrapping the parallel wire-fastener assembly into a relatively flat ended coil package without sacrificing density, it became necessary to modify the plastic trays to accommodate the flatter ends. The improved method of wrapping and improved flat ended package obtained thereby is disclosed in U.S. patent application Ser. No. 558,533, filed Dec. 6, 1983, the disclosure of which is hereby incorporated by reference into the present specification. Briefly, it will be noted that the flatten end fastener package is obtained by changing the lapped relationship of the heads in each volute with respect to the heads in the preceding volute, that is, first overlapping, then underlapping, then overlapping, etc.

SUMMARY OF THE INVENTION

The present invention has for its object the provision of a shipping package embodying the flat ended type coiled fastener packages which is effective in operation, more economical to manufacture and assemble, readily stored without the need for extraordinary fire precautions and which is readily disposed of after use. In accordance with the principles of the present invention this objective is achieved by providing a shipping package which includes an exterior carton having a rectangular bottom, four interconnected sides extending up from the periphery of said bottom and a top closure, which together define an interior space. A bottom panel is extended within the interior space adjacent the bottom, a top panel is extended within the interior space adjacent the top closure, and usually at least one divider panel is extended within the interior space in generally parallel relation with the bottom and top closure. The bottom panel includes an upwardly facing corrugated sheet having a flat sheet fixed to its opposite face. The top panel includes a downwardly facing corrugated sheet having a flat sheet fixed to its opposite face. Each divider panel includes a downwardly facing corrugated sheet, an upwardly facing corrugated sheet and flat sheets fixedly connected between and with the opposite faces of the upwardly facing corrugated sheet and the downwardly facing corrugated sheet. The panels divide the interior space into a plurality of tiered spaces, with each tiered space being defined along its lower surface by an upwardly facing corrugated sheet and along its upper surface by a downwardly facing corrugated sheet. A plurality of coiled fastener packages are mounted within each tiered space.

Each coiled fastener package presents a multiplicity of fastener heads defining one end thereof and a multiplicity of fastener points defining the other end thereof and is within its associated tiered space with the fastener head defining end thereof engaging one of the corrugated sheets defining the same so as to collapse the engaged corrugations thereof and with the fastener points defining end thereof engaging the other of the corrugated sheets defining the same so as to penetrate the engaged corrugations thereof. The collapse and penetration of the corrugated sheets effectively hold each fastener package against lateral movement during shipping. Since the panels embodying the corrugated sheets can be simply formed of kraft paper, an optimum cost is achieved together with non-toxic burning and biodegradable characteristics.

Preferably the corrugations of the upwardly facing corrugated sheet of each divider panel are parallel with the corrugations of the downwardly facing corrugated sheet of the divider panel and each end of each divider panel is folded transversely along a marginal line perpendicular to the longitudinal extent of the corrugations in closely spaced parallel relation to the associated end edge thererof.

Preferably, the upper and lower panels are each constructed similarly to each of the divider panels. In this way manufacture is simplified and made more economical since only one panel construction is required to be produced in mass.

These and other objects of the present invention will become more apparent during the course of the following detailed description and appended claims.

The invention may be best understood with reference to the accompanying drawings, wherein an illustrative embodiment is shown.

DETAILED DESCRIPTION OF PREFERRED EMBODIMENT

Figure 1:
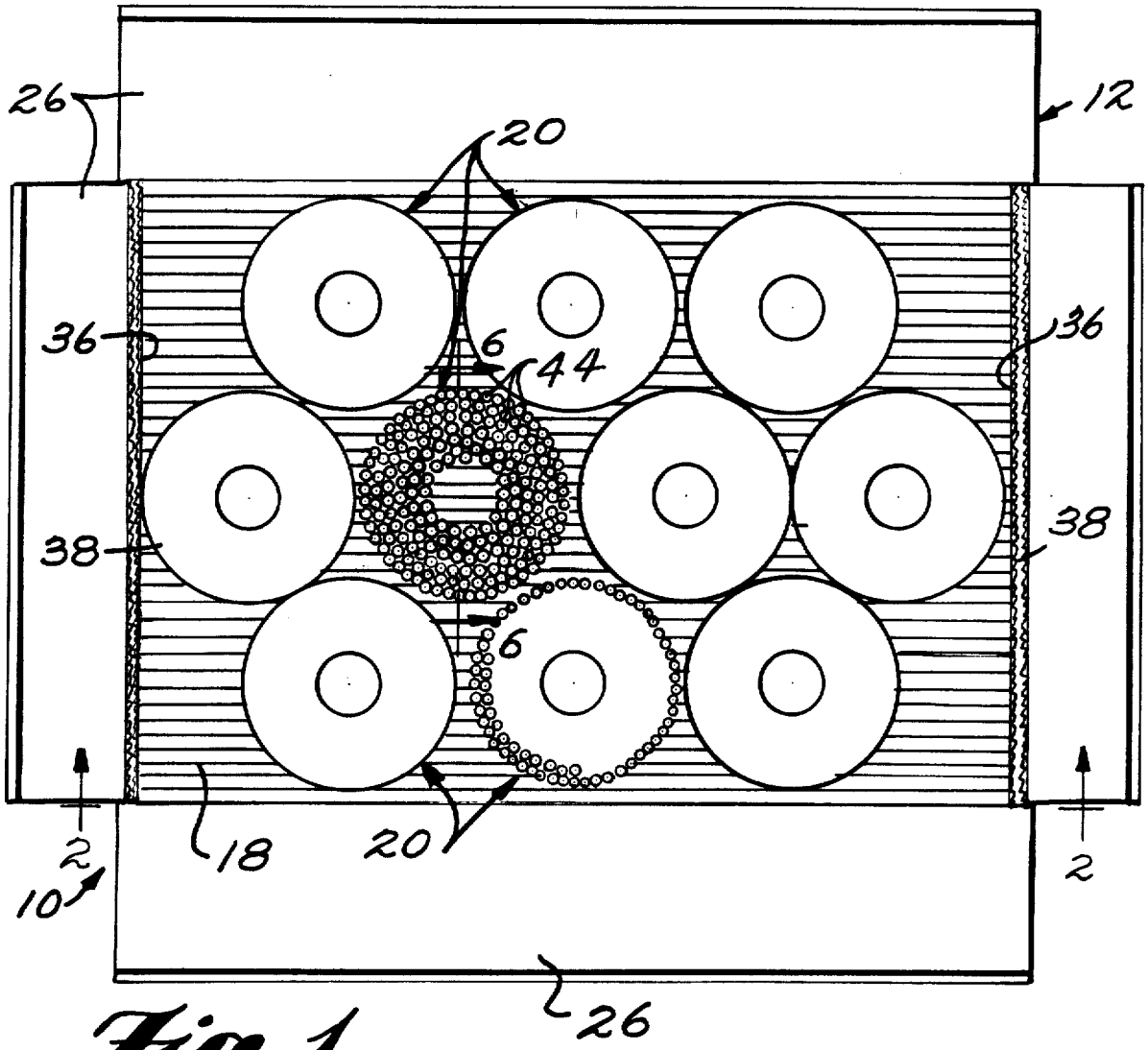
FIG. 1 is a top plan view of a shipping package embodying the principles of the present invention showing the same with the flaps defining the top closure in an open position and the top panel of the shipping package removed so as to more clearly illustrate the position of the coiled fastener packages therein.
Figure 2:
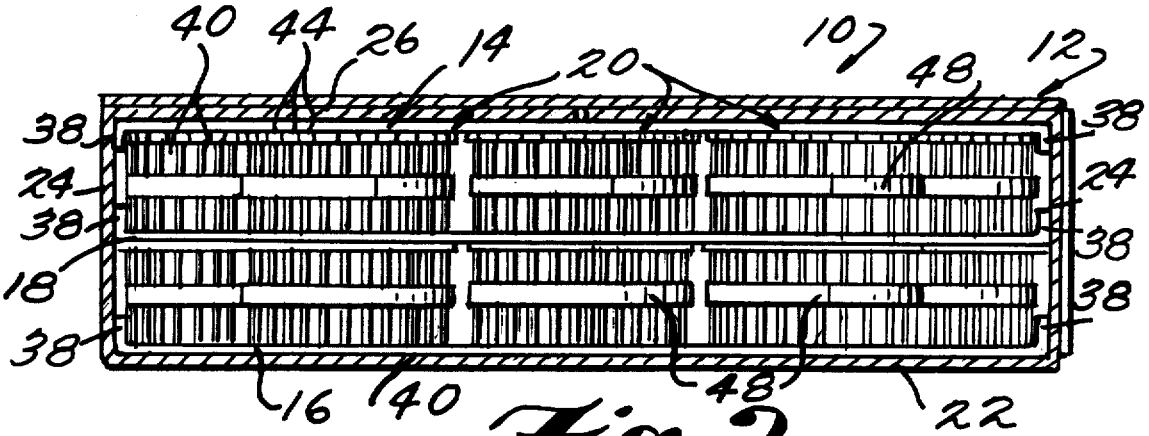
FIG. 2 is a vertical sectional view taken through the package along the line 2—2 of FIG. 1 but showing the top closure closed and the top panel in assembled relation.

Referring now more particularly to FIGS. 1 and 2 of the drawings, there is shown therein a shipping package, generally indicated at 10, which embodies the principles of the present invention. The shipping package 10 comprises in general an exterior carton, generally indicated at 12, which defines an interior space. A top panel 14, a bottom panel 16 and usually at least one divider panel 18 are mounted within the interior space of the carton 12 so as to divide the same into a plurality of tiered spaces, each of which has a plurality of coiled fastener packages, generally indicated at 20, stably supported therein.

The carton 12 may be of any conventional construction and, as shown, is formed of corrugated board which is cut, scored and folded to provide a bottom 22 of generally rectangular configuration in plan. Extending upwardly from the periphery of the bottom 22 are four interconnected sides 24 having flaps hinged to their upper edges capable of being closed to form a top closure 26.

In the preferred embodiment shown, all of the panels within the interior space of the carton 12, including the top panel 14, the bottom panel 16 and each divider panel 18, are of substantially identical construction, and consequently, a description of one will suffice to give an understanding of all.

Figure 3:
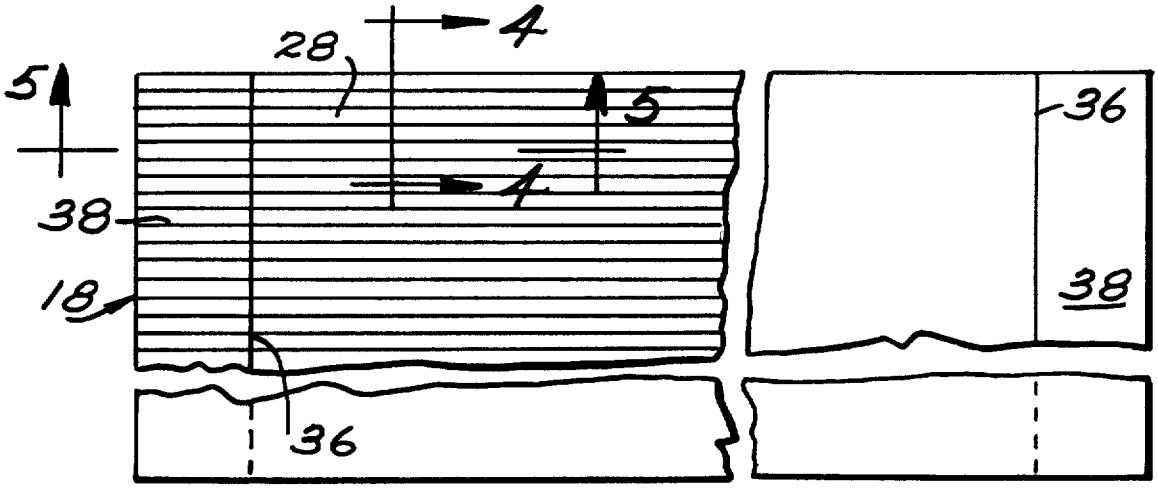
FIG. 3 is a fragmentary top plan view of an interior panel of the shipping package.
Figure 4:
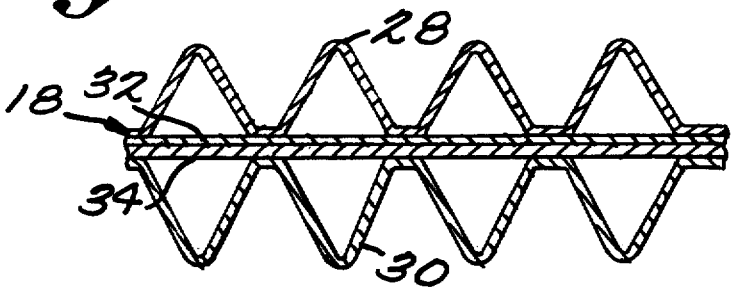
FIG. 4 is an enlarged fragmentary sectional view taken along the line 4—4 of FIG. 3.
Figure 5:
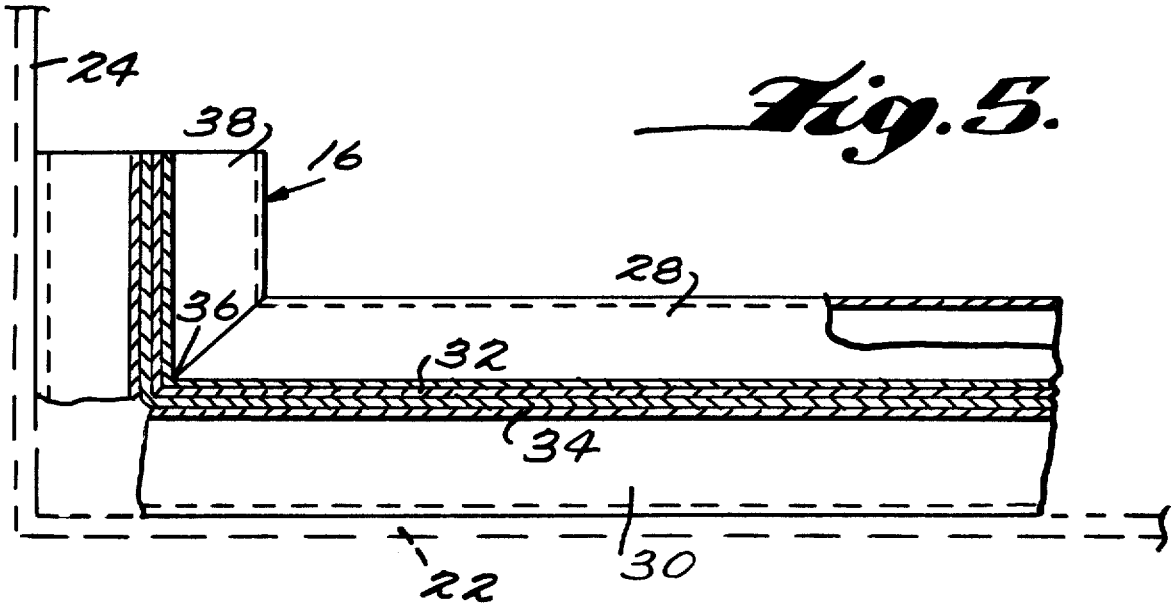
FIG. 5 is an enlarged fragmentary sectional view taken along the line 5—5 of FIG. 3.

As best shown in FIGS. 3-5, each panel includes an upwardly facing corrugated sheet 28, a downwardly facing corrugated sheet 30 and a pair of interior flat sheets 32 and 34 which are fixed together, as by gluing or the like, in face to face relation with respect to each other. Flat sheet 32 has its upper face fixed, as by gluing or the like, to the opposite face of the upwardly facing corrugated sheet 28. Flat sheet 34 has its lower face fixed, as by gluing or the like, to the opposite face of the downwardly facing corrugated sheet 30. As best shown in FIG. 4, the corrugated sheets 28 and 30 are so oriented with respect to one another that the corrugations of both sheets are disposed in parallel relation to one another.

This parallel corrugation relationship is preferred because it is easier to fabricate and assemble the panel in this configuration. That is, fabrication and assembly proceeds with all four sheets in a continuous condition advancing longitudinally, and while so advancing, each corrugated sheet is first glued to its associated flat sheet and then the opposite faces of the flat sheets are glued together. Thereafter the sandwich is cut up into short lengths. This arrangement, however, does not provide rigidity to the panel except in a direction perpendicular to the common parallel extent of the corrugations. Stated differently, the panel construction is capable of flexure in a direction parallel to the corrugations. To provide rigidity to each panel in this direction, a score line 36 is formed within both corrugated sheets along opposite edges of the panel which are perpendicular to the parallel extent of the corrugations. As shown, each score line 36 is spaced slightly inwardly from the associated edge so as to define a marginal edge portion 38 which is bent transversely along the score line. The transversely disposed marginal edge portions 38 at each end of each panel give the panel a shallow channel shaped configuration which lends rigidity to the panel in a direction parallel with the corrugations thereof.

Figure 6:
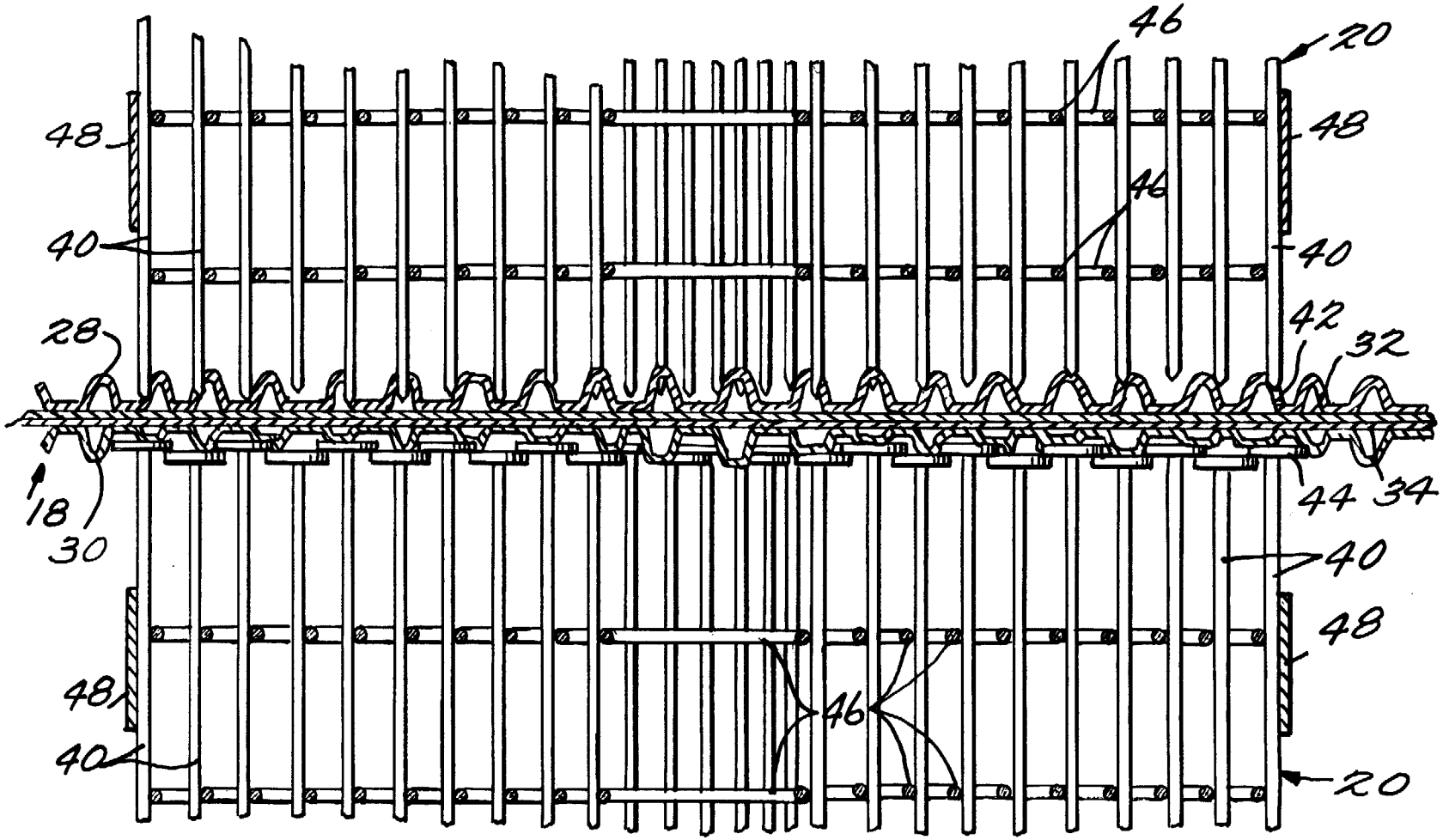
FIG. 6 is an enlarged fragmentary somewhat schematic sectional view taken along the line 6—6 of FIG. 1.

Referring now more particularly to FIGS. 1, 2 and 6, each coiled fastener package 20 is formed in accordance with the teachings contained in the aforesaid patent application from an assembly which includes a multiplicity of fasteners 40 which, as shown, are nails having an elongated shank, formed with a point 42 on one end and an enlarged head 44 on the opposite end thereof. The assembly also includes an elongated carrier for supporting the nails 40 in a row formation with their shanks in parallel relation to one another and extending transversely to the direction of elongation of the carrier. As shown, the carrier is in the form of two parallel weldable wires 46 which are disposed across the shanks of the nails and welded thereto. Each coiled package 20 is formed from the assembly by wrapping the assembly into a coil formation taking care to change the lapped relationship of the heads after each volute has been wrapped so that the heads alternate in alternating volutes from overlapping relation to underlapping relation to overlapping relation, etc. After the coil formation has been formed, the outer periphery of the coil formation is secured by wrapping a band 48 thereabout. The band 48 may be a rubber band or a paper band formed of a strip with the ends glued together. While it is preferred to use a band, the securement may be effected by a clip which serves to connect the outermost fastener to an adjacent fastener in the next volute.

In assemblying the shipping package 10, the flaps constituting the top closure 26 of the carton 12 are moved into an open position, such as shown in FIG. 1, and then the bottom panel 16 is placed within the interior space of the carton in abutting relation with the bottom 22 thereof. Note that marginal end portions 38 engage the associated carton sides 24 and are bent transversely upwardly so as to maintain the panel in its shallow channel configuration providing rigidity against flexure of the panel in a direction parallel with the corrugations. Next, a series of fastener packages 20 are mounted on the upwardly facing corrugated sheet 28 of the bottom panel 16. FIG. 10 illustrates a typical number of packages and a typical arrangement. Next, the divider panel 18 is mounted within the interior space of the open carton 12 in engagement with the upper surfaces of the coiled fastener packages 20.

It will be understood that while the package 10 shown in FIG. 2 utilizes only a single panel divider 18, that 2, 3 or more divider panels 18 may be utilized, depending largely on the height dimension of the packages 20. Moreover, it is within the contemplation of the present invention when dealing with fastener packages 20 having a height dimension of 3½ inches and more to provide a package 10 having only a single tier or layer that utilizes a top panel 14 and a bottom panel 16 without any divider panel 18. The upper corrugated sheet 28 of each divider panel 18 serves to support another series of coiled fastener packages 20. After the uppermost series of fastener packages 20 has been mounted within the carton interior space, the top panel 14 is then moved into engagement with the upper surface of the uppermost series of packages. Finally, it will be noted that the flaps which define the top closure 26 are moved into closing relationship. It will be noted that each of the panels is mounted within the interior space of the carton so that the marginal end portions 38 are bent transversely. The bottom panel 16 has its marginal edge portions 38 bent upwardly. The top panel 14 has its marginal edge portions 38 bent downwardly, and each divider panel 18 may have its marginal edge portions 38 bent either upwardly or downwardly.

Referring now more particularly to FIG. 2, it will be noted that the vertical dimensions of the components within the carton are such that when the carton is closed the components are vertically compressed together. The panels 14, 16 and 18 divide the interior space within the carton into a plurality of tiered spaces. The bottom surfaces of each tiered space is defined by an upwardly facing corrugated sheet 28 and the upper surface of each tiered space is defined by a downwardly facing corrugated sheet 30. With the fastener packages 20 oriented with their points 42 lowermost, it will be noted that due to the aforesaid vertical compression, the points tend to penetrate into the corrugations of the upwardly facing corrugated sheet 28, as shown in FIG. 6. In a like manner, the heads 44 tend to collapse the corrugations of the downwardly facing corrugated sheet 30 engaged thereby. The upper headed end of each package 20 may be regarded as seating upwardly and held within a downwardly facing recess formed by the collapse of the corrugations, whereas the pointed end of each package is held in pierced relation by the associated upwardly facing corrugated sheet 28. The combination of these two modes of retaining the ends of the fastener packages against movement effectively prevents their damage in shipment. It will be noted that the panels are preferably formed of conventional kraft paper which is relatively low cost, biodegradable and capable of non-toxic burning.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A shipping package comprising: an exterior carton having a rectangular bottom, four interconnected sides extending up from the periphery of said bottom and a top closure, said bottom, sides and top closure defining an interior space, a bottom panel extending within said interior space adjacent said bottom, a top panel within said interior space adjacent said top closure, at least one divider panel extending within said interior space in generally parallel relation with said bottom and top closure, said bottom panel including an upwardly facing corrugated sheet having flat sheet means fixed to its opposite face, said top panel including a downwardly facing corrugated sheet having flat sheet means fixed to its opposite face, each divider panel including a downwardly facing corrugated sheet, an upwardly facing corrugated sheet and flat sheet means fixedly connected between and with the opposite faces of said upwardly facing corrugated sheet and said downwardly facing corrugated sheet, each corrugated sheet including a multilplicity of elongated continuous side-by-side alternating ridges and troughs defining corrugations, each end of each divider panel being folded transversely along a marginal line perpendicular to the longitudinal extent of the corrugations in closely spaced parallel relation to the associated end edge thereof and being mounted in said interior space in said folded relation, said panels dividing said interior space into a plurality of tiered spaces, each tiered space being defined along its lower surface by an upwardly facing corrugated sheet and along its upper surface by a downwardly facing corrugated sheet, and a plurality of coiled fastener packages within each tiered space, each coiled fastener package presenting a multiplicity of fastener heads defining one end thereof and a multiplicity of fastener points defing the other end thereof, said panels and coiled fastener packages being vertically compressed within said exterior carton, each coiled fastener package being vertically compressed within its associated tiered space against movement by virtue of the fastener head defining end thereof engaging one of the corrugated sheets defining the same so as to collapse the engaged corrugations thereof and the fastener point defining end thereof engaging the other of the corrugated sheets defining the same so as to penetrate the engaged corrugations thereof.

2. A shipping package as defined in claim 1 wherein the flat sheet means of each divider panel comprises an upper flat sheet fixed to the other side of the upwardly facing corrugated sheet thereof and a lower flat sheet fixed to the other side of the downwardly facing corrugated sheet thereof, each pair of said upper and lower flat sheets being fixed together in face to face relation.

3. A shipping package as defined in claim 2 wherein the corrugations of the upwardly facing corrugated sheet of each divider panel are parallel with the corrugations of the downwardly facing corrugated sheet of said divider panel.

4. A shipping package as defined in claim 3 wherein said upper and lower panels are each constructed similarly to each divider panel.

5. A shipping package as defined in claim 4 wherein all of said sheets are formed of kraft paper.

6. A shipping package as defined in claim 5 wherein each coiled fastener package is formed by wrapping in coil formation an assembly comprising a multiplicity of fasteners each having a metal shank headed at one end and pointed at the other and carrier means supporting said fasteners with their shanks in parallel relation with respect to one another and in transverse relation with respect to direction of elongation of said carrier means.

7. A shipping package as defined in claim 6 wherein the exterior periphery of each coiled fastener package is secured by a band.

8. A shipping package as defined in claim 1 wherein all of said sheets are formed of kraft paper.

9. A shipping package as defined in claim 1 wherein each coiled fastener package is formed by wrapping in coil formation an assembly comprising a multiplicity of fasteners each having a metal shank headed at one end and pointed at the other and carrier means supporting said fasteners with their shanks in parallel relation with respect to one another and in transverse relation with respect to direction of elongation of said carrier means.

10. A shipping package as defined in claim 9 wherein the exterior periphery of each coiled fastener package is secured by a band.

11. A shipping package comprising: an exterior carton having a rectangular bottom, four interconnected sides extending up from the periphery of said bottom and a top closure, said bottom, sides and top closure defining an interior space, a layered assembly compressed vertically within the interior space of said exterior carton, said layered assembly including a layer of a plurality of coiled fastener packages, a lower panel within said interior space engaging beneath the layer of coiled packages and an upper panel within said interior space engaging above the layer of coiled packages, each lower panel including an upwardly facing corrugated sheet having flat sheet means fixed to its opposite face, each upper panel including a downwardly facing corrugated sheet having flat sheet means fixed to its opposite face, each corrugated sheet including a multiplicity of elongated continuous side-by-side alternating ridges and troughs defining corrugations, each end of each divider panel being folded transversely along a marginal line perpendicular to the longitudinal extent of the corrugations in closely spaced parallel relation to the associated end edge thereof and being mounted in said interior space in said folded relation, each coiled fastener package presenting a multiplicity of fastener heads defining one end thereof and a multiplicity of fastener points defining the other end thereof, each coiled fastener package being vertically compressed between said upper and lower panels against movement by virtue of the fastener head defining end thereof engaging an associated corrugated sheet so as to collapse the engaged corrugations thereof and the fastener point defining end thereof engaging the other of the associated corrugated sheets so as to penetrate the engaged corrugations thereof.

* * * * *

UNITED STATES PATENT AND TRADEMARK OFFICE

CERTIFICATE OF CORRECTION

PATENT NO. : 4,712,676

DATED : December 15, 1987

INVENTOR(S) : Everett H. Randall

It is certified that error appears in the above-identified patent and that said Letters Patent is hereby corrected as shown below:

On the title page
The inventor's name should appear on the patent as "Everett H. Randall".

Signed and Sealed this

Fifth Day of July, 1988

*Attest:*

DONALD J. QUIGG

*Attesting Officer*

*Commissioner of Patents and Trademarks*